US010116108B1

(12) United States Patent
Vidal et al.

(10) Patent No.: US 10,116,108 B1
(45) Date of Patent: Oct. 30, 2018

(54) TRACK-LIGHTING ADAPTER WITH UNIVERSAL HOUSING

(71) Applicant: GREEN CREATIVE, LTD, Hong Kong (CN)

(72) Inventors: Guillaume Vidal, Mende (FR); Zhang Yulin, Shanghai (CN)

(73) Assignee: Green Creative Ltd., Hong Kong (CN)

( * ) Notice: Subject to any disclaimer, the term of this patent is extended or adjusted under 35 U.S.C. 154(b) by 0 days.

(21) Appl. No.: 15/732,331

(22) Filed: Oct. 25, 2017

Related U.S. Application Data

(60) Provisional application No. 62/496,843, filed on Nov. 1, 2016.

(51) Int. Cl.

| | |
|---|---|
| ***H01R 25/14*** | (2006.01) |
| ***F21V 21/34*** | (2006.01) |
| ***F21V 23/06*** | (2006.01) |
| ***H01R 29/00*** | (2006.01) |
| *H01R 13/622* | (2006.01) |
| *H01R 103/00* | (2006.01) |
| *H01R 13/627* | (2006.01) |

(52) U.S. Cl.
CPC ..... *H01R 25/142* (2013.01); *F21V 21/34* (2013.01); *F21V 23/06* (2013.01); *H01R 29/00* (2013.01); *H01R 13/622* (2013.01); *H01R 13/627* (2013.01); *H01R 2103/00* (2013.01)

(58) Field of Classification Search
CPC ... H01R 25/142; H01R 13/622; H01R 13/627
USPC ..... 439/122
See application file for complete search history.

(56) References Cited

U.S. PATENT DOCUMENTS

| | | | | |
|---|---|---|---|---|
| 4,822,292 | A * | 4/1989 | Thayer | H01R 25/142 439/115 |
| 4,861,273 | A * | 8/1989 | Wenman | H01R 25/142 174/70 C |
| 5,151,038 | A * | 9/1992 | Range | H01R 25/142 439/117 |
| 6,079,992 | A * | 6/2000 | Kuchar | F21V 17/14 362/287 |
| 9,200,791 | B2 * | 12/2015 | Noh | F21V 23/02 |
| 9,291,338 | B2 * | 3/2016 | Liu | F21V 21/35 |
| 9,360,196 | B2 * | 6/2016 | Nicieja | H01R 13/6205 |
| 9,618,172 | B1 * | 4/2017 | Means, III | F21S 8/066 |
| 2016/0072243 | A1 * | 3/2016 | Arcykiewicz | H01R 13/42 439/121 |

* cited by examiner

*Primary Examiner* — Alexander Gilman
(74) *Attorney, Agent, or Firm* — James A. Gavney, Jr.; JAF Patent Service

(57) ABSTRACT

The present invention is directed to a power unit adapter mechanism for track-light systems that includes a universal housing. The universal housing is configured to couple any number of different styles or types of adapter caps to form power unit adapters that fit into corresponding power track styles to power light engines. The universal housing has a geometric configuration and includes the necessary electrical contacts that allow the universal housing to be used with variety of adapters caps styles.

8 Claims, 5 Drawing Sheets

TRACK-LIGHTING ADAPTER WITH UNIVERSAL HOUSING

RELATED APPLICATION

This application claims priority under 35U.S.C. § 119(e) from the co-pending U.S. provisional patent application Ser. No. 62/496,843, filed on Nov. 1, 2016, and titled "TRACK-LIGHTING ADAPTER WITH UNIVERSAL HOUSING." The provisional patent application Ser. No. 62/496,843, filed on Nov. 1, 2016, and titled "TRACK-LIGHTING ADAPTER WITH UNIVERSAL HOUSING" is hereby incorporated by reference.

FIELD OF THE INVENTION

This invention relates to track-lighting systems. More particularly, the present invention relates to track-lighting systems with a power adapter that includes a universal housing.

BACKGROUND OF THE INVENTION

Track-lighting refers to light fixtures that are cable of being attached anywhere along a continuous electrified track; in contrast to lighting that usually requires electrical wiring to each individual light fixture position. Track-lighting has the advantage of being capable of being mounted to a variety of structural surface, such as ceilings, walls, beams and rafters.

Typical track-lighting systems have a line voltage running through a recessed track or power track. The power track may have more than one live conductor, so that multiple switching circuits can be used to control different lights operating from the same power track. Systems often operate with low voltage (10, 12, or 24 volts). In this case, the power track is electrified through a low-voltage transformer. Some newer track-lighting systems use a single live conductor and a suitable digital control interfaces, such as DALI to control each adapter coupled to the track.

There are generally three standard types of power tracks or power track styles that use corresponding power unit adapters referred to as "H", "J", and "L" styles. Each of the different types or styles of power tracks requires different corresponding power unit adapters. Power unit adapters, herein, refer to the portion, or portions of a track-light system that couple light engines to a power track.

SUMMARY OF INVENTION

The present invention is directed to a power unit adapter mechanism for a track-light system that includes a universal housing. The universal housing is configured to couple any number of styles or types of adapter caps to form power unit adapters that fit into corresponding power track styles and power light engines. The universal housing is configured to, for example, couple to, but not limited to, "H", "J", and "L" style adapter caps to form adapter power units that can be fitted into corresponding "H", "J", and "L" style power tracks. The universal housing has a geometric configuration and includes the necessary electrical contacts that allow the universal housing to be used with the variety of different adapter cap styles.

DETAILED DESCRIPTION OF THE INVENTION

Figure 1A:
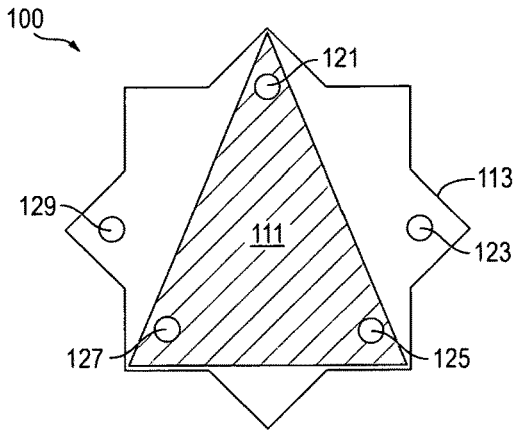
FIGS. 1A-C show schematic representations of a universal housing geometrically configured and with contacts to electrically couple to variety of adapter caps to form track-light adapter power units for powering track-lighting, in accordance with the embodiments of the invention.

Referring to FIG. 1A, a track -light adapter power unit 100 is formed with a universal housing 113 that has a number of electrical contacts 121, 123, 125, 127 and 129. The electrical contacts 121, 123, 125, 127 and 129 can be pin contacts, male or female pin contacts configured to couple to corresponding female or male on a cap adapter. At least a portion the contacts 121 and 125 and 127 couple to matched contacts on a cap adapter 111 to provide power input from a track 301, 325 and 350 (FIGS. 3A-B) and power an output cord 251 (FIG. 2B) to power a light engine (not shown).

Figure 1B:
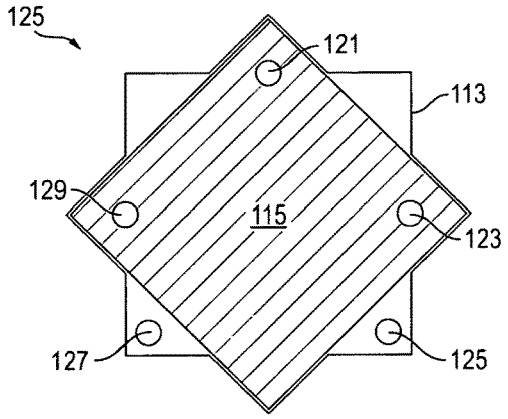

Referring to FIG. 1B, a track-light power unit 125 is formed with a universal housing 113, shown in FIG. 1A, that has a number of electrical contacts 121, 123, 125, 127 and 129. A different portion of the contacts 121 and 123 and 129 couple to matched contacts on a different cap adapter 115 to provide power input from a track 301, 325 and 350 (FIGS. 3A-B) and power an output cord 251 (FIG. 2B) to power a light engine (not shown).

Figure 1C:
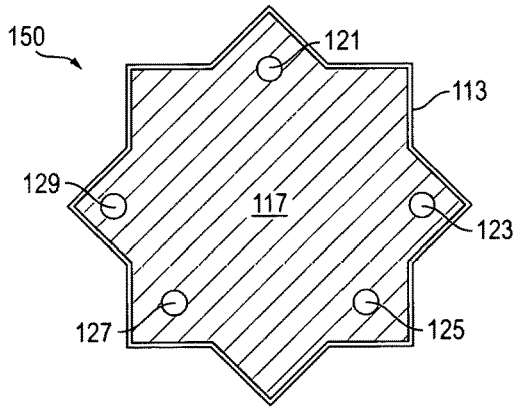

Referring to FIG. 1C, a track-light power unit 150 is formed with a universal housing 113, such as shown in FIGS. 1A-B, that has a number of electrical contacts 121, 123, 125, 127 and 129. A different portion of electrical contacts 121, 123, 125, 127 and 129 couple to matched contacts on a different cap adapter 117 to provide power input from a track 301, 325 and 350 (FIGS. 3A-B) and power an output cord 251 (FIG. 2B) to power a light engine (not shown).

The universal housing 113 is constructed with an adaptable geometric structure and/or the adaptable electrical contact lay out to allow a variety of track-light adapter power units 100, 125 and 150 to be formed by attaching different cap adapters 111, 115 and 117 that can then be used to electrically couple a power track designed for the specific cap adapter used. The universal housing of the present invention can be used to couple to any number of types of adapter caps including, but not limited to, "H", "J", and "L" style adapter caps to form corresponding track-light adapter power units.

Figure 2A:
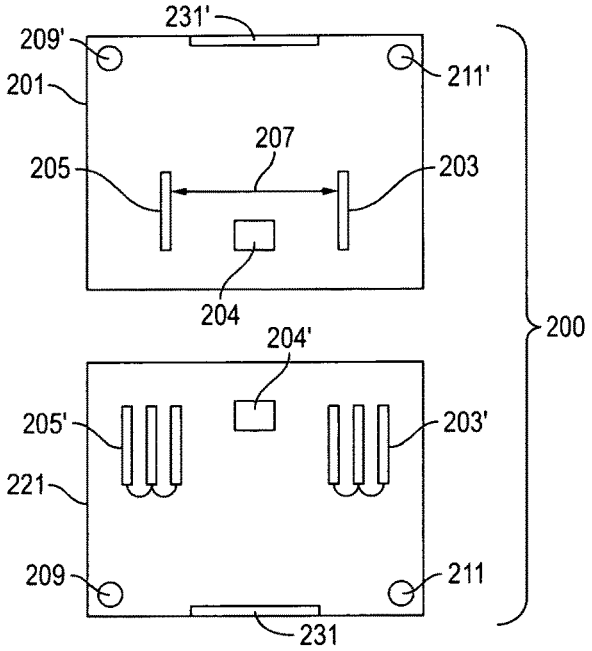
FIGS. 2A-B show schematic representations of a universal housing with spaced contacts to electrically couple to variety of adapter caps to form track-light adapter power units, in accordance with the embodiments of the invention.
Figure 2B:
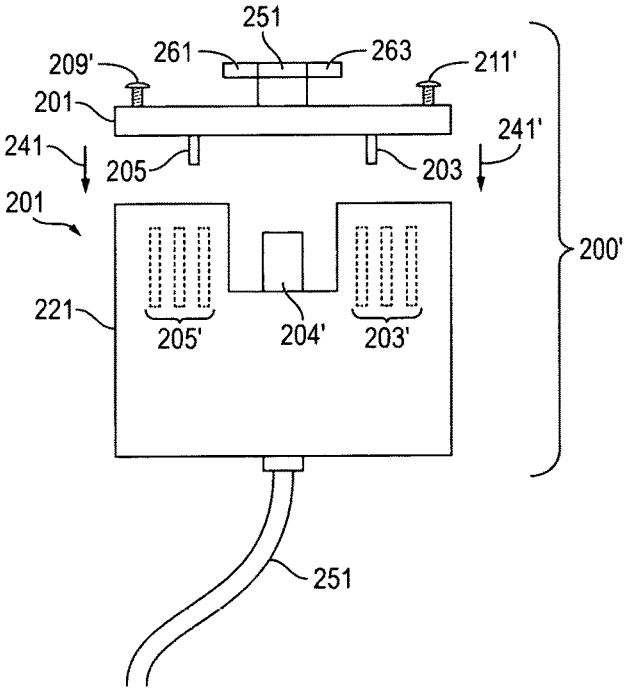

FIGS. 2A-B show schematic representations 200 and 200' of a universal housing 221 with spaced contacts 203' and 205' and a fixed contact 204'. The spaced contacts 203' and 205' allow the universal housing 221 to couple to matched contacts 203, 204 and 205 on different adapter caps 201 with electrical contacts 203 and 205 having a range of different configurations or spacings, as indicated by the arrow 207.

In operation the adapter cap 201 is attached to the universal housing 221, as indicated by the arrows 241 and 241'. The electrical connections 203, 204 and 205 then engaged with a portion of the spaced electrical connections 203' 204' and 205' that match the locations of the electrical connections 203, 204 and 205 (matched electrical connections) on the adapter cap 201. The adapter cap 201 is then secured to the universal housing 221 through matched threaded and screw features 209/209' and 211/211' and/or matched two-part snap features 231 and 231'. The spaced electrical connections 203' 204' and 205' of the universal housing 221 are electrically connected to an output cord 251 and the matched electrical connections 203, 204 and 205 on the adapter cap 201 are in electrical connection with slide contacts 261 and 263 on a track stud feature 251. The track stud feature 251 is inserted into a power track 301, 325 and 350 (FIGS. 3A-C) that corresponds to type of adapter cap and track stud 251. A light engine connected to the chord 251 is then powered from slide contacts 261 and 263 through the track-light adapter power unit 200' formed by the adapter cap 201 and the universal housing 221 and through the chord 251.

Figure 3A:
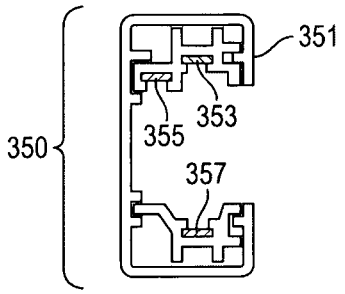
FIGS. 3A-C show cross-sectional views of power tracks that couple to track-light adapter power units with a universal housing, in accordance with the embodiments of the invention.
Figure 3B:
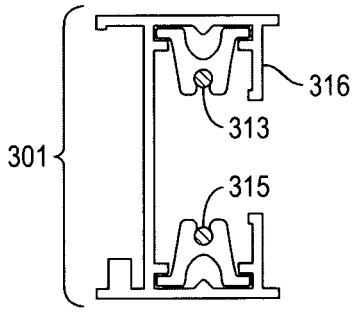
Figure 3C:
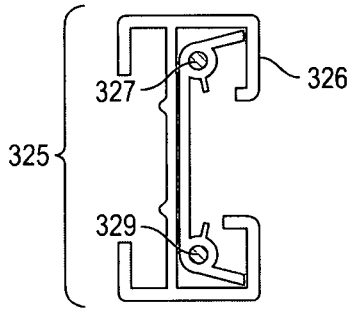

FIGS. 3A-C show cross-sectional views of power tracks 301, 325 and 350 that couple to track-light adapter power units through matched track stud features (such as the track stud feature 251) on adapter caps used form the adapter power units with the universal housing of the present invention. While the present invention has been described as being used for single power track configurations, the present invention can also be used for two power track or three power track configurations Referring to FIG. 3A, the power track 350 includes a track 351. Power tracks are usually formed for extruded metal or plastic and have insulated contacts 353, 355 and 357. The cross-sectional view of the power track shown in FIG. 3A is similar to a cross-sectional view of a H-style power track. A H-style power track 350 has three insulated contacts 353, 355 and 357, one of which is configured to supply a ground. The insulated contacts 353, 355 and 357 engage with three slide contacts on a matched track stud feature (H-style) on a H-style adapter cap 401 (FIG. 4A) that to fits into the power track 350.

Referring to FIG. 3B, the power track 301 includes a track 316, such as described above, with insulated contacts 313 and 315. The power track 301 shown in FIG. 3B is similar to a cross-sectional view of a L-style power track. The insulated contacts 313 and 315 engage with slide contacts, such as the slide contacts 261 and 263 (FIG. 2B), on a matched track stud feature (L-style) on a L-style adapter cap 421 (FIG. 4B) that fits into the power track 301.

Referring now to FIG. 3C, the power track 325 includes a track 326, such as described above, with insulated contacts 327 and 329. The cross -sectional view of the power track shown in FIG. 3C is similar to a cross-sectional view of a J-style power track. The insulated contacts 327 and 329 engage with slide contacts, such as the slide contacts 261 and 263, on a matched track stud feature (J-style) on a J-style adapter cap 431 (FIG. 4C) that fits into the power track 325.

While the track-light adapter power units described herein have been referenced with respect to track-light power units formed from a universal housing and L, J and H style adapter caps, it will be clear to one skilled in the art that the universal housing of the present invention can be used to make track-light adapter power units with any number of different adapter cap styles to be used with any number of corresponding power tracks styles. Also, where the track-light adapter power units of the present invention are used to power LED light fixtures, the LED drivers can be include on the power track, within the track-light adapter power units or within the LED light engine itself.

Figure 4C:
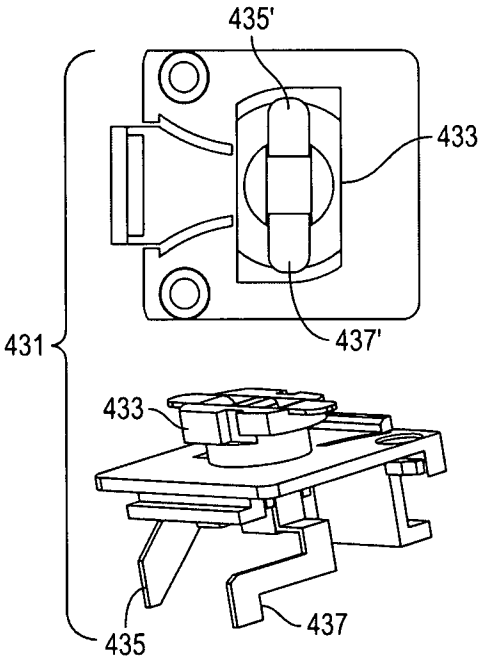
FIGS. 4A-C show top views and perspective views of track-lighting adapter caps that are coupled to a universal housing to form track-light adapter power units, in accordance with the embodiments of the invention.
Figure 4B:
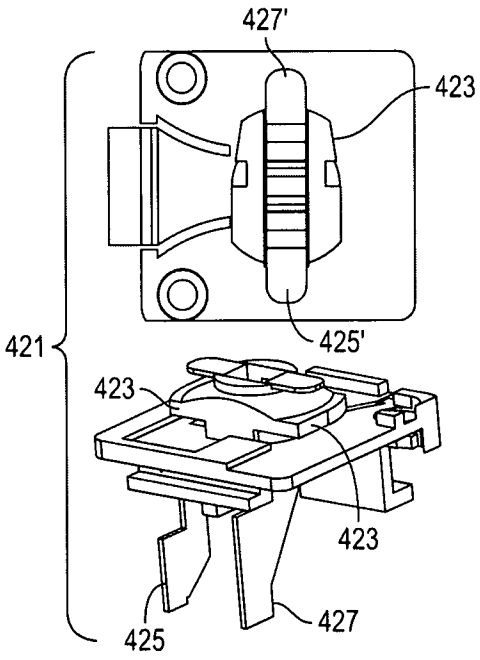
Figure 4A:
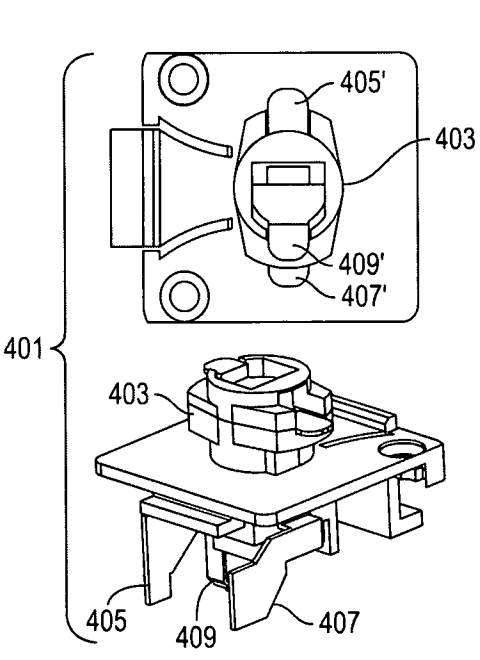
Figure 5:
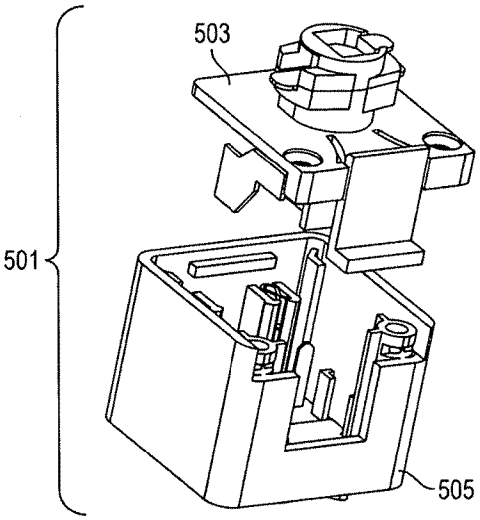
FIG. 5 shows a view of an example of a H-style adapter cap coupling to a universal housing to form a track-light adapter power unit, in accordance with the embodiments of the invention.

FIGS. 4A-C are top views and perspective views of track-lighting adapter caps that couple to a universal housing 505 (FIG. 5) to form track-light adapter power units, in accordance with the embodiments of the invention. Referring to FIG. 4A, a H-style adapter cap 401 includes a H-style track stud 403 with three slide contacts 405' 407' and 409' that are electrically coupled to contacts 405 407 and 409. The contacts 405 407 and 409 engage spaced electrical contacts 203', 204' and 205' (FIGS. 2A-B) in a universal housing structure to form a track-light adapter power unit, similar to the track-light adapter power unit 501 (FIG. 5). The H-style track stud 403 slidably fits into the H-style power track 350 (FIG. 3A) and provides power to power track-lighting through the three slide contacts 405' 407' and 409'.

Referring to FIG. 4B a L-style adapter cap 421 includes a L-style track stud 423 with two slide contacts 425' and 427' that are electrically coupled to contacts 425 and 427. The contacts 425 and 427 engage spaced electrical contacts 203' and 205' (FIGS. 2A-B) in a universal housing structure to form a track-light adapter power unit, similar to the track-light adapter power unit 501 (FIG. 5). The L-style track stud 423 slidably fits into the L-style power track 301 (FIG. 3B) and provides power to power track-lighting through the two slide contacts 425' and 427'.

Referring to FIG. 4C a J-style adapter cap 431 includes a J-style track stud 433 with two slide contacts 435' and 437' that are electrically coupled to contacts 435 and 437. The contacts 435 and 437 engage spaced electrical contacts 203' and 205' (FIGS. 2A-B) in a universal housing structure to form a track-light adapter power unit, similar to the track-light power unit 501 (FIG. 5). The J-style track stud 423 slidably fits into the J-style power track 325 (FIG. 3C) and provides power to power track-lighting through the two slide contacts 435' and 437'.

FIG. 5 shows a view of an example of a H-style adapter cap 401 coupling to a universal housing 505 to form a track-light power unit 501, in accordance with the embodiments of the invention. The adapter cap 401 is attached to the universal track-light housing through snap features and/or screw features, such as described with reference to FIGS. 2A-B.

As described above with reference to FIGS. 1A-C, the connectors on the adapter caps used and the universal housing can have any number of shapes, such as matched male and female pin shapes. An while the adapter cap is described as being secured to the universal housing 221 through matched threaded and screw features 209/209' and 211/211' and/or matched two-part snap features 231 and 231', in FIGS. 2A-B, the connector on the adapter cap and the universal housing can serve as the mechanical mechanism for securing the adapter cap and the universal housing together.

Figure 6:
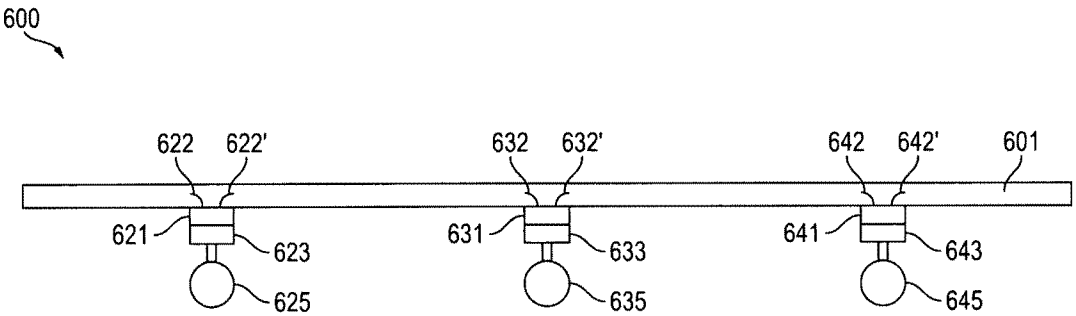
FIG. 6 shows a schematic representation of a track-lighting system that utilized track-light adapter power units formed from adapter caps and universal housings, in accordance with the embodiments of the invention.

FIG. 6 shows a schematic representation of a track-light system 600 that utilized track-light adapter power units formed from adapter caps 621, 631 and 641 and universal housings 623, 633 and 643. The track-light adapter power units are slidably coupled to a track-light power track 601 that provides electrical current from slide contacts 622/622'. 632/632' and 642/642' to power track-lights or light engines 625, 635 and 645.

The present invention has been described in terms of specific embodiments incorporating details to facilitate the understanding of the principles of construction and operation of the invention. For example, the universal track-light housing 221 (FIGS. 2A-B) and 505 (FIG. 5) can have any number of shapes including, but not limited to circular shapes, rectangular shapes and other geometric shapes. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A track-light system comprising a universal housing for connecting to a light engine, the universal housing including at least two different sets of spaced electrical contacts that electrically couple to different configurations of matched electrical contacts on at least two different track-light adapter cap styles to form at least two different track-light adapter power units, wherein the at least two different track-light adapter cap styles have track studs with slide contacts that are electrically coupled to the matched electrical contacts and that slidably and electrically engage different power track styles to power the light engine.

2. The track-light system of claim 1, wherein the at least two different track-light adapter cap styles include adapter caps with three matched electrical contacts.

3. The track-light system of claim 1, wherein the universal housing attaches to the at least two different track-light adapter cap styles through two-part snap features and/or matched thread and screw features.

4. The track-light system of claim 1, wherein the spaced electrical contacts include male or female pin contacts.

5. A track-light system comprising a universal housing, the universal housing including spaced electrical contacts that electrically couple to matched electrical contacts on H-style, L-style and J-style adapter caps to form H-style, L-style and J-style track-light adapter power units that slidably engage corresponding H-style, L-style and J-style power tracks to power light engines.

6. The track-light system of claim 5, wherein the universal housing attaches to the H-style, L-style and J-style adapter caps through two-part snap features and/or matched thread and screw features.

7. The track-light system of claim 5, wherein the spaced electrical contacts that electrically couple to matched electrical contacts include pin contacts.

8. A track-light system comprising a universal housing for connecting to a light engine, different adapter cap styles, wherein the universal housing has different sets of spaced electrical contacts that electrically couple to each of the different adapter cap styles to provide power to the light engine through slide contacts on the different adapter cap styles that slidably fit into two correspondingly different power tracks and wherein the different adapter cap styles include H-style, L-style and J-style adapter caps.

* * * * *